United States Patent [19]

Bouchard et al.

[11] 4,263,850

[45] Apr. 28, 1981

[54] PYROTECHNIC CAP WITH MOISTURE INDICATOR

[75] Inventors: Andre C. Bouchard, Peabody; Thomas J. Sentementes, Wakefield; Harold H. Hall, Jr., Marblehead, all of Mass.

[73] Assignee: GTE Products Corporation, Stamford, Conn.

[21] Appl. No.: 2,272

[22] Filed: Jan. 10, 1979

[51] Int. Cl.[3] ..... F42C 19/08

[52] U.S. Cl. ..... 102/205; 102/29; 149/15

[58] Field of Search ..... 102/29, 205; 149/2, 149/15–18, 37

[56] References Cited

U.S. PATENT DOCUMENTS

| | | | |
|---|---|---|---|
| 2,036,511 | 4/1936 | Vanderpool et al. | 102/29 |
| 2,909,121 | 10/1959 | Gernert et al. | 102/29 X |
| 2,985,979 | 5/1961 | Doyle et al. | 42/1 N |
| 3,118,798 | 1/1964 | Winckler | 149/37 X |
| 3,667,992 | 6/1972 | Brown et al. | 149/16 X |
| 3,849,923 | 11/1974 | Hawkins | 42/1 N |
| 4,130,082 | 12/1978 | Bouchard et al. | 116/5 |
| 4,160,062 | 7/1979 | Gawlick et al. | 149/15 X |

FOREIGN PATENT DOCUMENTS

| | | | |
|---|---|---|---|
| 1424524 | 5/1972 | United Kingdom | 149/29 |

*Primary Examiner*—Peter A. Nelson
*Attorney, Agent, or Firm*—Lawrence R. Fraley

[57] ABSTRACT

An improved pyrotechnic cap capable of being activated by the radiant energy from an adjacent flashlamp. The cap includes a light-transmitting plastic container with a quantity of pyrotechnic composition hermetically sealed therein. Receipt of the described radiant energy causes activation of the composition whereby the cap produces an audible signal of high intensity (e.g. 158 to 164 decibels at 25 centimeters). The improvement comprises adding a moisture-indicating material (e.g. cobalti, cobaltous cyanide) to the cap to detect harmful quantities of moisture present within the container and change color in a discernible manner as a result of said detection.

11 Claims, 1 Drawing Figure

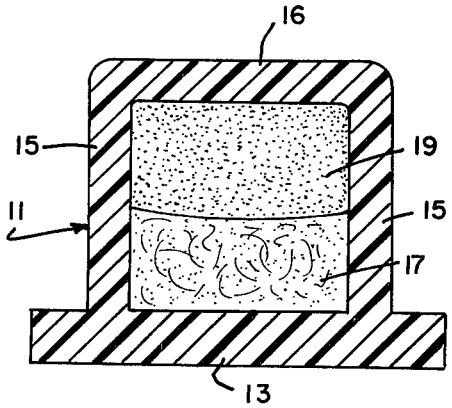
16
15
19
11
15
17
13

PYROTECHNIC CAP WITH MOISTURE INDICATOR

CROSS-REFERENCE TO COPENDING APPLICATIONS

An application under Ser. No. 2,263 was filed Jan. 10, 1979 entitled "Heat-Sealed Pyrotechnic Cap and Method of Making" (Inventors: A. C. Bouchard et al), describes a method for providing a hermetic seal in the end of a plastic cap containing a quantity of radiant energy activated pyrotechnic material therein. The formed cap may include a nonreactive filler located therein separate from and atop the pyrotechnic material to serve as a support for the sealed end.

An application under Ser. No. 2,264 was also filed Jan. 10, 1979 entitled "Pyrotechnic Cap With Mechanically Desensitized Composition" (Inventors: T. L. Gavenonis et al), defines a cap wherein the pyrotechnic composition includes a quantity of desensitizer material which serves to substantially decrease the cap'sensitivity to ignition by mechanical impact or crushing.

An application under Ser. No. 2,265 entitled "Radiant Energy Activated Pyrotechnic Cap Having Desiccant Therein" (Inventor: J. W. Shaffer) was also filed Jan. 10, 1979. In Ser. No. 2,265, a pyrotechnic cap is provided with a quantity of desiccating material, e.g, activated alumina, which is positioned within the cap's plastic container adjacent the pyrotechnic composition and serves to absorb moisture which is able to enter the cap, e.g., in the event of a defective seal.

In addition to the above applications, U.S. Pat. No. 4,130,082 entitled "Flashlamp Assembly For Providing Highly Intense Audible and Visual Signals" (Inventors: A. C. Bouchard et al) was filed June 6, 1977 and describes a hermetically-sealed pyrotechnic cap adapted for being activated by the light and/or heat from a chemical flashlamp. U.S. Pat. No. 4,130,082 is assigned to the same assignee as the instant invention, as are all of the aforementioned copending applications.

BACKGROUND OF THE INVENTION

The invention relates to pyrotechnic caps and particularly to hermetically-sealed pyrotechnic caps capable of being activated by radiant energy in the form of light and/or heat.

In the aforementioned U.S. Pat. No. 4,130,082, there is described a unique concept in the production of high intensity audible and visual signals. As described therein, it has been discovered that hermetically-sealed plastic caps having certain pyrotechnic compositions therein can be instantaneously activated by the highly intense light and/or heat from an adjacent chemical flashlamp to produce an aubible signal also of high itensity (e.g. approaching 165 decibels). The preferred activating flashlamps are percussively-activated chemical flashlamps as presently utilized in the photoflash products manufactured and sold by the assignee of the instant invention under the name MAGICUBE. By chemical flashlamp is meant one having a glass envelope containing a combustion-supporting atmosphere and a quantity of filamentary combustible material (e.g. shredded zirconium) therein. Percussive activation of such a lamp occurs when a metal tube which comprises part of the lamp is deformed by mechanical impact whereupon primer material therein deflagrates up through the tube to ignite the filamentary combustible material in the lamp's envelope. As also described in U.S. Pat. No. 4,130,082, it is possible to activate the sealed caps using other varieties of chemical flashlamps such as those which are electrically activated. One example of this latter type are flashlamps currently utilized in the photoflash products manufactured and sold by the assignee of the instant invention under the name FLIP-FLASH.

A primary use for the device in U.S. Pat. No. 4,130,082 is as an intrusion alarm. The device may also comprise part of an alarm system wherein a suitable detector is used to receive the device's output and thereafter perform an auxillary function (e.g. emit a prolonged, high intensity signal). Quite understandably, devices such as alarm systems must possess a high degree of reliability. Accordingly, it is essential that the cap member which comprises an integral part of the device must possess a similar functioning ability.

It has been determined that the presence of moisture within the cap, even in relatively minor quantities, can adversely affect both the cap's reliability and the uniformity of loudness of the emitted audible signal. This moisture may enter the cap either during manufacture thereof or subsequent to said manufacture by penetration of a defective seal. Under extreme conditions (e.g. high relative humidity for prolonged periods at elevated temperatures), it might also be possible for moisture to permeate the preferred plastic materials used for the cap's container.

It is believed, therefore, that a pyrotechnic cap member including means for visibly indicating the presence of harmful quantities of moisture therein in order that the cap user can effect replacement of the member would constitute a significant advancement in the art.

OBJECTS AND SUMMARY OF THE INVENTION

It is, therefore, a primary object of the present invention to provide a pyrotechnic cap member which includes means for visibly indicating the presence of harmful quantities of moisture within the cap's container.

In accordance with one aspect of the invention, there is provided an improved pyrotechnic cap member which is capable of being activated by the radiant energy from an adjacent chemical flashlamp to produce an audible signal of high intensity. The improvement comprises adding a quantity of moisture-indicating material within the cap's plastic container which visibly changes color when a harmful level of moisture is present within the container.

BRIEF DESCRIPTION OF THE INVENTION

The drawing is an elevational view, in section, of a pyrotechnic cap member in accordance with a preferred embodiment of the invention.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawing.

With particular reference to the drawing, there is shown a pyrotechnic cap member 10 which comprises a plastic container 11 which in cross-secion includes a base portion 13, at least two upstanding sides 15, and a hermetically-sealed end portion 16. (One method of providing container 11 with sealed end 16 is disclosed in the copending application under Ser. No. 2,263. The plastic material for container 11 is a thermoplastic, preferably high density polyethylene. It is understood, however, that other plastics could be used, including low density polyethylene, polypropylene, polyvinyl chloride, polycarbonates, etc. The container as shown is preferably cylindrical in configuration but could of course assume other shapes, including rectangular, hexagonal, etc. With added regard to the invention, container 11 must be light-transmitting; that is, it must be either translucent or transparent to permit viewing therethrough by the cap's user.

Cap 10 includes a quantity of pyrotechnic composition 17 which is hermetically sealed within container 11. Examples of suitable pyrotechnic materials for use in the invention are described in the aforementioned U.S. Pat. No. 4,130,082. A preferred material is one containing potassium chlorate, red phosphorous, manganese dioxide, and a dispersing agent. Pyrotechnic materials known as "Armstrong's Mixtures" may also be used with the present invention. These compositions typically include potassium chlorate within the range of about 67 to 81 percent, phosphorous from about 8 to 27 percent, sulfer from about 3 to 9 percent, and precipitated chalk from about 3 to 11 percent. All of these percentages are by weight of the material.

As an alternate embodiment, it may be desirable to use a pyrotechnic mixture which emits a "whistling" or similar sound. Such materials are well known in the art and may contain potassium chlorate, potassium perchlorate, potassium nitrate, red gum, gallic acid, potassium picrate, potassium benzoate, potassium dinitrophenate and sodium salicylate. These formulations are shown on pages 376 and 377 of the book entitled "Miltary and Civilian Pyrotechnics" by Dr. Herbert Ellern, copyright 1968 by The Chemical Publishing Co., Inc. The aforementioned "Armstrong's Mixtures" are defined on page 353 of this text.

The above nonwhistling materials assure an audible signal of high intensity when the cap is activated by the energy from an adjacent flashlamp. By high intensity is meant an output of above 85 decibels measured at a distance of 25 centimeters. The preferred range when cap 11 is utilized in the aforedescribed invention is from about 158 to about 164 decibels at this distance.

For toxicity consideration, compositions including red phosphorous and potassium chlorate are preferred. One disadvantage of red phosphorous is that it possesses a tendency to prematurely degrade when in the presence of even minor quantities of moisture, particularly in the presence of traces of degradation-catalyzing metals such as iron and copper. These metals may be found in even the most purified commercial grades of red phosphorous. The end result of such degradation is that the cap's ability to absorb radiant energy as well as the rate of burning of the member during activation is adversely affected. Burning rate, in turn, affects the level and uniformity of the generated audible signal. Furthermore, the presence of excessive amounts of moisture can result in the cap becoming totally inoperable for the purpose defined.

It has been found, quite unexpectedly, that it is possible to add a quantity of moisture-indicating material 19 of the type to be described within the cap's container 11 prior to sealing of the container which not only permits the cap's user to readily ascertain whether or not harmful quantities of moisture are present therein but also assures that the operability of the cap is not adversely affected. By moisture-indicating is meant a material possessing an ability to change color in the presence of moisture to an extent that said change is readily discernible to the cap's user. Furthermore, material 19 must be compatible with the described pyrotechnic compositions and must not interfere in any manner with the cap's receiving of the essential, activating radiant energy. The cap is thus fully capable of emitting the aforedefined audible signals at the indicated levels. Testing of several caps containing these materials has also proven that loudness uniformity is maintained.

In one embodiment, moisture-indicating material 19 comprised a composition of cobalti, cobaltous cyanide and a plastic (e.g. a polyolefin). Both the cyanide and the plastic were in powder form with the plastic comprising from about 85 to about 95 percent by weight of the total composition. The preferred plastic powder is polyethylene and is available from USI Chemicals, New York, New York under the product name FN-500 Microthene F. The plastic and cyanide were mixed together by vigrous agitation with the resulting material having a pale blue color, indicating an absence of moisture. Several transulcent polyethylene containers 11 were each filled with from about 3 to about 17 milligrams of pyrotechnic composition 17 which was deposited in slurry form. After drying of the composition was achieved, from about 3 to about 40 milligrams of powdered material 19 was added after which cap 10 was hermetically sealed. As illustrated in FIG. 1, material 19 is located atop (and therefore adjacent) the pyrotechnic composition 17. The blue color of material 19 was observable through the sealed end 16 of translucent container 11.

It is understood that the present invention is not limited to the material or the ranges described above. For example, it is also possible to use powdered cobalt chloride in combination with the polyolefin. It is even further possible to eliminate the need for the plastic powder and instead directly mix the cobalti, cobaltous cyanide or cobalt chloride with the dry pyrotechnic composition. In this event, said material should comprise from about 10 to 30 percent by weight of the combined pyrotechnic-additive composition. It can be seen, therefore, that material 19 may be located separately (i.e. atop) from the pyrotechnic composition, as shown in FIG. 1, or the indicating portion thereof directly mixed with composition 17 as an additive thereto. In either case, it was possible to detect the presence of harmful quantities of moisture within container 11 due to the container's contents changing to a pink color. It is estimated that the continual exposure of approximately two microliters of water to the quantities of pyrotechnic described above could possibly result in a reduction of the report from cap 10. In the event of a defective seal in end 16, it is possible to introduce the above quantity of water by exposing the cap to 95 percent relative humidity at 95 degrees Farenheit for a 24-hour time period. Understandably, caps possessing proper seals would require far greater exposure levels before permeation of the container's plastic side walls or end by the above quantity of water could be achieved.

In still another embodiment of the invention a 0.356 cm. diameter paper disk member impregnated with cobalt chloride was inserted within container 11 atop the dried pyrotechnic 17. The disk, having a thickness of 0.127 cm., was die cut from a larger sheet of material available from the Humidal Corp., Cotton, Calif. These sheets are available in various humidity level indicating ranges (i.e. from 10% to 100% in 10% increments). A disk which changed from blue to pink at 60% relative humidity was chosen in one embodiment of the invention.

There has thus been shown and described a radiant energy-activated pyrotechnic cap which includes means for visibly detecting the presence of harmful quantities of moisture therein in order that the cap may be discarded and replaced by an adequate substitute. The moisture-indicating materials as described provide this highly advantageous feature without adversely affecting the cap's operability.

While there have been shown and described what are at present considered the preferred embodiments of the invention, it will be obvious to those skilled in the art that various changes and modifications may be made therein without departing from the scope of the invention as defined by the appended claims.

We claim:

1. In a pyrotechnic cap for providing an audible signal of high intensity upon receipt of energy in the form of light and/or heat from a flashlamp wherein said cap includes a light-transmitting, plastic container having a pyrotechnic composition hermetically sealed therein separately from said flashlamp, the improvement wherein said container further includes a quantity of a moisture-indicating material therein, said material changing color to provide a visual indication to the user of said cap upon detection of a predetermined quantity of moisture within said plastic container.

2. The improvement according to claim 1 wherein said moisture-indicating material is in powder form and is located adjacent said pyrotechnic composition.

3. The improvement according to claim 2 wherein said moisture-indicating material is selected from the group consisting of cobalti, cobaltous cyanide, and cobalt chloride.

4. The improvement according to claim 3 wherein said moisture-indicating material further includes a quantity of plastic powder, said plastic powder comprising from about 85 to about 95 percent by weight of said material.

5. The improvement according to claim 4 wherein said plastic powder is a polyolefin.

6. The improvement according to claim 5 wherein said plastic powder is polyethylene.

7. The improvement according to claim 1 wherein said moisture-indicating material is admixed with said pyrotechnic composition.

8. The improvement according to claim 7 wherein said moisture-indicating material is selected from the group consisting of cobalti, cobaltous cyanide and cobalt chloride.

9. The improvement according to claim 7 wherein said moisture-indicating material comprises from about 10 to about 30 percent by weight of said pyrotechnic composition.

10. The improvement according to claim 1 further including a paper member located within said container adjacent said pyrotechnic composition, said moisture-indicating material impregnated within said paper member.

11. The improvement according to claim 10 wherein said moisture-indicating material is selected from the group consisting of cobalti, cobaltous cyanide and cobalt chloride.

* * * * *